US011619432B2

(12) United States Patent
Fonte et al.

(10) Patent No.: US 11,619,432 B2
(45) Date of Patent: Apr. 4, 2023

(54) HEAT PUMP SYSTEM

(71) Applicant: Carrier Corporation, Palm Beach Gardens, FL (US)

(72) Inventors: Nicolas Fonte, Montluel (FR); Hugo Herry, Montluel (FR); Arnaud Veneziani, Villeurbanne (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 193 days.

(21) Appl. No.: 17/111,213

(22) Filed: Dec. 3, 2020

(65) Prior Publication Data

US 2021/0247117 A1 Aug. 12, 2021

(30) Foreign Application Priority Data

Feb. 6, 2020 (EP) ..... 20155902

(51) Int. Cl.
*F25B 47/02* (2006.01)

(52) U.S. Cl.
CPC .... *F25B 47/025* (2013.01); *F25B 2313/0292* (2013.01); *F25B 2313/0315* (2013.01)

(58) Field of Classification Search
CPC ..... F25B 47/025; F25B 2313/0292; F25B 2313/0315; F25B 2500/31; F25B 2600/2513; F25B 2700/197; F25B 2700/2106; F25B 2700/21151; F25B 2700/2117; F25B 2700/21175; F25B 47/006; F25B 30/02; F25B 49/02; F25B 2341/064
USPC ..... 62/225
See application file for complete search history.

(56) References Cited

U.S. PATENT DOCUMENTS 4,768,348 A * 9/1988 Noguchi ..... B60H 1/321 62/211
2004/0244398 A1 12/2004 Radermacher et al.
2008/0016896 A1 1/2008 Rasch et al.
2009/0277207 A1 11/2009 Park
(Continued)

FOREIGN PATENT DOCUMENTS

CN 100404975 C 7/2008
CN 203286809 U 11/2013
(Continued)

OTHER PUBLICATIONS

European Search Report for European Application No. 20155902.8; Report dated Aug. 12, 2020 (pp. 1-8).

*Primary Examiner* — Marc E Norman
*Assistant Examiner* — Matthew John Moscola
(74) *Attorney, Agent, or Firm* — Cantor Colburn LLP

(57) ABSTRACT

A heat pump system includes a compression device 12, a heat rejecting heat exchanger 14, an expansion device 18 and a heat absorbing heat exchanger 16; wherein the expansion device 18 provides a controllable degree of expansion. The heat pump system is operated in accordance with a method including determining a temperature indicative of frosting conditions on an exterior surface of the heat absorbing heat exchanger 16; operating the heat pump system in a first mode if the temperature indicative of frosting conditions is above a threshold value, and operating the heat pump system in a second mode if the temperature indicative of frosting conditions is within a range of temperatures that is below the threshold value.

16 Claims, 1 Drawing Sheet

(56) References Cited

U.S. PATENT DOCUMENTS

| | | | | |
|---|---|---|---|---|
| 2013/0174595 | A1* | 7/2013 | Okuda | F25B 45/00 62/238.6 |
| 2015/0292786 | A1 | 10/2015 | Andersson | |
| 2019/0107314 | A1* | 4/2019 | Watanabe | F25B 47/025 |

FOREIGN PATENT DOCUMENTS

| | | | |
|---|---|---|---|
| CN | 103245151 | B | 2/2015 |
| CN | 103216981 | B | 4/2015 |
| CN | 105423661 | A | 3/2016 |
| CN | 105066526 | B | 5/2017 |
| EP | 2372272 | A1 | 10/2011 |
| JP | 2009074754 | A | 4/2009 |
| JP | 5100416 | B2 | 12/2012 |
| KR | 102049426 | B1 | 11/2019 |

* cited by examiner

HEAT PUMP SYSTEM

CROSS-REFERENCE TO RELATED APPLICATIONS

This application claims priority to European Patent Application No. 20155902.8, filed Feb. 6, 2020, the contents of which are incorporated by reference herein in their entirety.

BACKGROUND

The invention relates to a method for operating a heat pump system, as well as to a corresponding heat pump system.

As is well known, refrigeration or heating can be provided by a refrigeration system making use of the refrigeration cycle, in which a refrigerant fluid is compressed, cooled, expanded and then heated. In one common usage, where such a refrigeration cycle is used for satisfying a heating load, the cooling of the refrigerant fluid is done via a heat rejection heat exchanger rejecting heat to a space within a building and the heating of the refrigerant fluid is done via a heat absorbing heat exchanger that absorbs heat from outside of the building to be occupied by people. In this way the refrigeration cycle can transfer heat from outside of the building to within the building even when the interior is cooler than the atmosphere. A full or partial phase change of the refrigerant fluid can be used to increase the possible temperature differential between the heat rejection and heat absorption stages.

With such a heat pump system the heat absorbing heat exchanger, typically an evaporator, carries low temperature refrigerant fluid in order to absorb heat even when the outside air temperature is low. Under some conditions this generates a risk of frosting on the exterior surfaces of the heat absorbing heat exchanger.

SUMMARY

Viewed from a first aspect, the invention provides a method for operating a heat pump system, the heat pump system comprising: a compression device, a heat rejecting heat exchanger, an expansion device and a heat absorbing heat exchanger; wherein the expansion device provides a controllable degree of expansion; the method comprising: determining a temperature indicative of frosting conditions on an exterior surface of the heat absorbing heat exchanger; operating the heat pump system in a first mode if the temperature indicative of frosting conditions is above a threshold value; and operating the heat pump system in a second mode if the temperature indicative of frosting conditions is within a range of temperatures that is below the threshold value; wherein in the second mode the heat pump system is arranged to adjust the degree of expansion at the expansion device to increase the superheat at the outlet of the heat absorbing heat exchanger compared to the superheat when operating in the first mode to thereby increase an external temperature of the heat absorbing heat exchanger.

Traditionally such a heat pump system might be configured to operate with minimal superheat at the outlet of the heat absorbing heat exchanger in order to maximise capacity. This may be similar to operation in the first mode of the above method. The inventors have realised that benefits can arise by operating in a second mode with increased superheat when the outside air temperature is within a certain range, as determined based on the temperature indicative of frosting conditions. With this arrangement the heat pump system can operate with an increased external temperature of the heat absorbing heat exchanger, and this allows for an extended temperature range where the heat absorbing heat exchanger can be operated without the formation of frost.

When there is frost on exterior surfaces of the heat absorbing heat exchanger then the operating efficiency of the heat pump system can reduce, often by as much as 20%. It is hence advantageous to delay frost formation using a mode with increased superheat as set out above, since although the increased superheat would reduce the capacity of the system compared to normal frost-free operation, the avoidance of frost gives a bigger gain than this reduction in capacity. This can be particularly valuable in areas where the outside air temperature often falls into the range where frost can initially form, such as temperatures in the range 1-9° C. or 2-7° C., without staying below freezing for sustained periods. These conditions often arise in populated locations of the world, such as across much of Europe.

The step of determining a temperature indicative of frosting conditions may comprise determining the outside air temperature. The outside air temperature is the temperature of outside air external to the heat absorbing heat exchanger. Alternatively, the step of determining a temperature indicative of frosting conditions may comprise determining some other temperature linked to the outside air temperature and/or to the temperature of the exterior surface of the heat absorbing heat exchanger. This may include using temperature sensors for some other indirect measure of one of those temperatures. Alternatively or additionally the method may use a more direct measure of the temperature of the exterior surface of the heat absorbing heat exchanger, such as via a temperature sensor in thermal contact with the exterior surface. In one example the method may use a combination of determining an outside air temperature and the refrigerant fluid temperature at the outlet of the heat absorbing heat exchanger to assess a likelihood of frosting conditions on the exterior surface of the heat absorbing heat exchanger.

The method may control the expansion device in order that the level of superheat is sufficient to prevent frost formation on the heat absorbing heat exchanger when the temperature indicative of frosting conditions (e.g. outside air temperature) is within the range of temperatures below the threshold value. Thus, the control of expansion when operating in the second mode may be such that the lowest outside temperature of the heat absorbing heat exchanger is above a minimum defrosting value, for example above 0° C. The outside temperature of the heat absorbing heat exchanger may be the temperature of the exterior surface such as a fin or the like, with the lowest outside temperature being at the cold end (outlet end) of the heat absorbing heat exchanger.

The expansion device provides a controllable degree of expansion that is utilised in order to control the superheat at the outlet of the heat absorbing heat exchanger as discussed above. The expansion device may be any suitable controllable expansion device for reducing the pressure of the refrigerant fluid, such as an electronic expansion valve for example.

The degree of expansion at the expansion device may be actively controlled, with the degree of expansion (e.g. a degree of opening of an expansion valve) varying as the temperature indicative of frosting conditions (e.g. the outside air temperature) varies. This may be done so that the increase in superheat is used to prevent frost without excessive superheat, which could unnecessarily reduce capacity. As noted above, the first mode of operation may involve a conventional control of superheat for minimum superheat in the heat absorbing heat exchanger. The second mode of operation may involve increasing superheat sufficient to prevent frost, e.g. to elevate the exterior temperature of the heat absorbing heat exchanger as above, without significantly exceeding the required increase.

The method may control the superheat at the outlet of the heat absorbing heat exchanger based on the difference between the threshold value and the outside air temperature, such as in proportion with that difference or based on some other function determined for the purpose of preventing frost. Such a function may vary for different forms of the heat absorbing heat exchanger. The required function may be determined empirically and/or by modelling. The method may use a table of outside air temperature and superheat, or a table of outside air temperature and an expansion requirement. Thus, as the outside temperature varies within the range below the threshold value then the expansion device may be actively controlled to give the required superheat. It will be appreciated that by using superheat in this way, such as with active control of the expansion device based on the outside air temperature, then it becomes possible to operate frost-free without any other modification to the heat pump system.

The heat pump system may not require additional defrosting devices for the heat absorbing heat exchanger and hence may be absent one or more additional defrosting devices. The heat pump system advantageously does not include a separate heater for defrosting the exterior surfaces of the heat absorbing heat exchanger, for example there may not be any form of electric heater or the like. Thus, the heat pump system may use the control of the expansion deice for superheat to avoid frost within the range of temperatures that is below the threshold value without the need for any other source of heat. The superheat may hence be the sole reason for the increase in exterior temperature of the heat absorbing heat exchanger when operating in the second mode.

The range of temperatures below the threshold value may be a range having a lower bound where the heat pump system is switched back to the first mode of operation. This would then allow formation of frost, with the consequent drop in efficiency, but it will be appreciated that as the temperature becomes lower then the cost in efficiency of increasing superheat rises, such that at some point it becomes optimal to operate in a "normal" mode, i.e. the first mode of operation, with frost being permitted. The second mode of operation can hence be considered to be a frost delaying mode, which uses the increased superheat to reduce the outside air temperature where frost may form.

The range of temperatures below the threshold value may be a range between a first threshold value, which is the threshold value discussed above, and a second threshold value that is lower than the first threshold value. The heat pump system may be switched from the first mode of operation to the second mode of operation at the first threshold value, in order to delay frost formation, and switched from the second mode of operation to the first mode of operation at the second threshold value, which may then permit frost once the outside air temperature is too low for the use of superheat to be efficient. The first threshold value may be a temperature indicative of an outside air temperature in the range 6-13° C., optionally in the range 7-11® C., such as a temperature value of about 9° C. or about 10° C. As noted above, the method may include measuring the outside air temperature directly via use of an outside air temperature sensor. The second threshold value may be a temperature indicative of an outside air temperature in the range 0-6° C., optionally in the range 1-4° C., such as a temperature value of about 2° C. or about 3° C. Thus, for example, the heat pump system may be use the second mode of operation when it is determined that the outside air temperature is in the range 2-10° C. or 3-7° C.

The method may include determining superheat of the refrigerant at the outlet of the heat absorbing heat exchanger. This may involve measurements of refrigerant temperature and pressure at one or more points within the heat pump system, such as by measurements taken at the outlet of the heat absorbing heat exchanger and/or at the compressor suction inlet. The skilled person will be aware of various techniques for determining suitable measures of superheat that may be used in this context.

As noted above, the method may include determining the outside air temperature, either directly or indirectly. For example, the method may include using a temperature sensor to measure the air temperature external to the heat absorbing heat exchanger. It is relatively common for the external parts of a heat pump system to include an outside air temperature sensor and conveniently the current method may use an existing sensor of this type. Alternatively the method may determine a measurement that reflects variations in outside air temperature, and thereby indirectly determine the outside air temperature. It will be appreciated that determining the outside air temperature may include any measurement that is equivalent to determining when temperature drops below a threshold at which there is a risk of frosting as discussed above.

The heat absorbing heat exchanger is typically an evaporator of the heat pump system. The exterior surface of the heat absorbing heat exchanger may be an exterior surface of heat absorbing elements such as fins of the heat exchanger. An example arrangement has two, three or more rows of heat absorbing elements, e.g. three rows of fins, which may be coupled to multiple rows of heat exchanger tubes that carry the working fluid of the heat pump system for heat exchange with the outside air. It will be appreciated that the greatest risk of frosting is at the final row of such a multi-row heat exchanger, closest to the outlet for the working fluid in the heat pump system, where the outside air passing over the exterior surface will be at its coldest and the fin temperature also at its coldest. The proposed operating method may hence involve increased superheat within the final row of fins of the heat absorbing heat exchanger during operation in the second mode in order to prevent frosting thereon. Advantageously, superheat may be avoided within other rows in order to maximise capacity of the heat pump system.

The compression device may be any suitable device for raising the pressure of the refrigerant fluid, and hence may be a compressor of any suitable type. The compression device may be arranged to operate with single phase refrigerant, i.e. fully gaseous refrigerant, or with a two phase refrigerant having a mix of liquid and gas phases. The compression device can have an inlet connected to a fluid pathway from the heat absorbing heat exchanger and an outlet connected to a fluid pathway to the heat rejecting heat exchanger. In some examples the fluid pathways provide a direct connection with no other refrigeration system components that would modify the state of the refrigerant fluid. The compression device may have an intermediate inlet, such as for connection to an economiser line.

The heat pump system may include an economiser line. The economiser line may be connected to or interact with the expansion device. The economiser line may extend to the intermediate inlet of the compressor from a branch point in the heat pump system after the heat rejection heat exchanger and prior to, or at, the expansion device. There may be an economiser valve in the economiser line for economised expansion and for control of the degree of economiser flow, as well as an economiser heat exchanger for heat exchange between refrigerant fluid in the economiser line after the economiser valve and refrigerant fluid in the heat pump system after the branch point and prior to the expansion device.

The heat rejection heat exchanger may be a condenser.

The method may include using the heat pump system for heating of a building, and in that case the heat absorbing heat exchanger may be located external to the building, with the outside air temperature hence being the temperature at the outside of the building and in the vicinity of the heat absorbing heat exchanger.

It will be appreciated that the main components of the heat pump system are the same as for existing heat pump systems, with the primary modification being in relation to the control of the expansion valve for increased superheat. The method above may hence be implemented on pre-existing heat pump systems such as via modifications to the control system and/or to software thereof. Advantageously such a modification/upgrade may make used of an existing outside air temperature sensor.

Viewed from a second aspect, the invention provides a computer programme product comprising instructions for execution on a controller for a heat pump system comprising: a compression device, a heat rejecting heat exchanger, an expansion device and a heat absorbing heat exchanger; wherein the expansion device provides a controllable degree of expansion; wherein the instructions, when executed will configure the controller to operate the heat pump system in accordance with the method discussed above in relation to the first aspect or optional features thereof.

Viewed from a third aspect, the invention provides a heat pump system comprising: a compression device, a heat rejecting heat exchanger, an expansion device and a heat absorbing heat exchanger; wherein the expansion device provides a controllable degree of expansion; the heat pump system being arranged to: receive measurements for a temperature indicative of frosting conditions on an exterior surface of the heat absorbing heat exchanger, operate in a first mode if the temperature indicative of frosting conditions is above a threshold value, and operate in a second mode if the temperature indicative of frosting conditions is within a range of temperatures that is below the threshold value, wherein in the second mode the heat pump system is arranged to adjust the degree of expansion at the expansion device to increase the superheat at the outlet of the heat absorbing heat exchanger compared to the superheat when operating in the first mode to thereby increase an external temperature of the heat absorbing heat exchanger.

The heat pump system may include a controller for receiving the measurements of temperature and for controlling the operating mode of the heat pump system. The controller may hence be configured for controlling the expansion valve to increase superheat as set out above. The heat pump system of the second aspect may be arranged to operate in accordance with the method discussed above in relation to the first aspect or optional features thereof. It may include features of the heat pump system as mentioned above, such as in relation to one or more of the expansion device, heat exchangers, compressor, temperature sensors, superheat sensors and so on.

DRAWING DESCRIPTION

Certain preferred embodiments will now be described by way of example only and with reference to the accompanying drawings in which.

DETAILED DESCRIPTION

Figure 1:
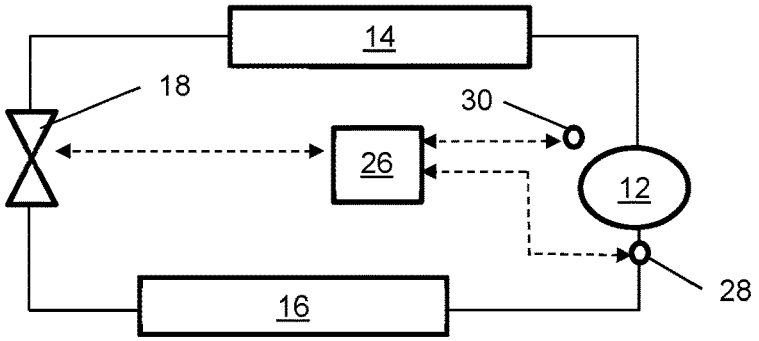
FIG. 1 shows a heat pump system.

As seen in FIG. 1, a heat pump system includes a compression device 12, a heat rejecting heat exchanger 14, an expansion device 18 and a heat absorbing heat exchanger 16 that operate together in a refrigeration/heat pump cycle. The heat pump system contains a refrigerant fluid and circulation of the refrigerant fluid via the compression device 12 enables the refrigeration system to utilise a refrigeration cycle (heat pump cycle) to satisfy a heating load. In this example the compression device 12 is a compressor 12 for compression of gaseous refrigerant fluid, the heat rejecting heat exchanger 14 is a condenser for at least partially condensing the refrigerant fluid, the expansion device 18 is an expansion valve for expanding the refrigerant fluid with a controllable degree of expansion, and the heat absorbing heat exchanger 16 is an evaporator for at least partially evaporating the refrigerant fluid. The heat pump system may advantageously be arranged so that the fluid is fully condensed at the condenser 14, and fully evaporated at the evaporator 16.

The heat pump system is controlled by a controller 26, which in this example controls the expansion device 18 based on input from a superheat sensor 28 and outside air temperature sensor 30 as discussed below. The controller 26 can also be used for control and/or monitoring of other parts of the refrigeration system, such as the compressor 12.

Figure 2:
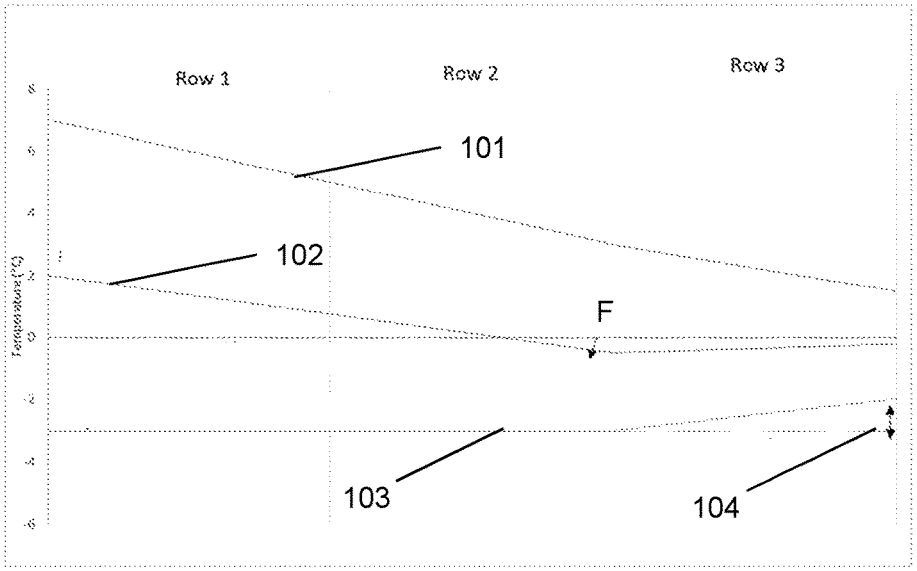
FIG. 2 is a graph showing parameters at a heat absorbing heat exchanger of the heat pump system with a risk of frosting.

A set of typical operating parameters for the heat absorbing heat exchanger 16 are shown in FIG. 2, for an example in which the heat absorbing heat exchanger 16 is a evaporator 16 with three rows of fins. The graph of FIG. 2 illustrates the air temperature 101 of air passing over the fins, the fin wall temperature 102, and the refrigerant temperature 103, i.e. the temperature of the working fluid within the evaporator 16. This graph relates to an outside air temperature of about 7° C., which is the outside air temperature prior to heat absorption and prior to flow of air over the evaporator 16, as shown at the left hand end of the plot of fin air temperature 101.

As a result of the heat exchange process the air temperature 101 close to the evaporator 16 fin wall decreases across the rows of fins, and the fin wall temperature 102 likewise decreases. The refrigerant temperature 103 is below 0° C. at the point of evaporation, and in this example it the evaporation temperature is −3° C. When the ambient outside air temperature is below a threshold value, which may typically be a value between 6-13° C. depending on the nature of the evaporator, then it is possible for the fin wall temperature to drop below 0° C., with frost forming on the evaporator exterior as a consequence. If frost forms then the efficiency of the system is reduced. FIG. 2 shows a situation in which frost will form on the third row of fins, as indicated by the arrow F, when the fin wall temperature drops below 0° C.

For a "normal" mode of operation, without taking account of frosting, the most effective control of the heat pump system would be for a constant refrigerant temperature in the evaporator 16, with heat absorption occurring via evaporation of the refrigerant fluid (in this case at −3° C.). This may be a first mode of operation for the heat pump system described herein, providing maximum heating capacity by avoiding unnecessary superheat.

In the example plots of FIG. 2 there is some slight superheat 104 in the third row as shown in the plot of refrigerant temperature 103, but it is not sufficient to prevent frost formation. The effect of the superheat is to increase the refrigerant temperature 103 and consequently increasing the fin wall temperature 102 as shown. The heat pump system can be controlled to provide a required degree of superheat by control of the expansion valve 18. The example plots of FIG. 2 do not show an effective use of such superheat, since the fin wall temperature 102 still drops below 0° C. allowing frosting to occur.

Figure 3:
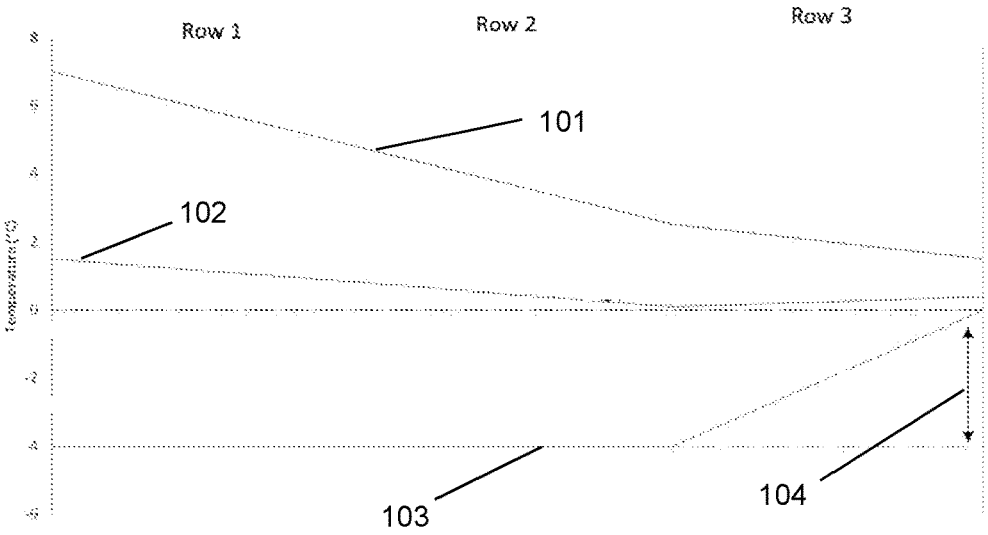
FIG. 3 shows similar parameters after implementation of a modified, second, mode of operation of the heat pump system to delay formation of frost.

The superheat within the outlet end of the evaporator 16 can be further increased when the outside air temperature drops sufficiently for there to be a risk of frost formation, and an example of this is shown in FIG. 3. This illustrates a possible second mode of operation for the heat pump system, with this second mode being adopted when the outside air temperature is within a set range below a threshold value, as discussed further herein. A measure of the outside air temperature can be done directly, such as via an outside air temperature sensor 30 as in FIG. 1. The superheat 104 at the outlet of the evaporator 16 is increased to a level sufficient to keep the fin wall temperature 102 above 0° C. via control of the expansion device 18. The fin air temperature 101 increases accordingly. The increased superheat 104 means that the refrigerant temperature 103 increases above the evaporation temperature, leading to a drop in efficiency, but this drop in efficiency is balanced by the increased effectiveness of the heat transfer when there is no frost formed on the exterior surfaces of the evaporator 16. Thus, there are gains in performance by delaying frost formation, i.e. by reducing the outside air temperature at which the evaporator 16 would be operated in a frosted state.

As a basic example, noting that the temperature ranges and so on may be adjusted dependent on the nature of the heat absorbing heat exchanger and on external conditions, such as taking account of outside air humidity, the heat pump system may be arranged to operate in a first mode with minimal superheat until the outside air temperature drops below a first threshold value, such as being below 7° C. as in FIGS. 2 and 3. In the first mode the heat pump system may be controlled to provide a refrigerant temperature 103 that remains constant at all points within the heat absorbing heat exchanger 16, as with an evaporator 16 operating at the evaporation temperature of the refrigerant. This may involve a refrigerant temperature of −3° C. as noted above.

When the outside air temperature drops below the threshold then the heat pump system is instead operated in a second mode, which can be similar to that shown in FIG. 3. In the second mode the superheat 104 is increased at the outlet of the heat absorbing heat exchanger with the increase in refrigerant temperature 103 acting to increase the fin wall temperature 102 to above 0° C. and hence prevent frost formation. The second mode is used within a range of outside air temperatures until the temperature drops so far that the second mode does not provide any increase in performance over that of a frosted heat exchanger. For a typical heat exchanger this can be at outside air temperatures below 2° C., so that the second mode is used for outside air temperatures below 7° C. and above 2° C. It will be appreciated that this lower threshold may vary depending on the parameters linked to the heat pump system, such as the drop in efficiency of heat exchange that arises from frosted operation and the drop in heating capacity that arises due to the added superheat 104. Below the lower threshold temperature, i.e. an outside air temperature of 2° C. in the example above, the heat pump system is again operated in the first mode.

Referring again to FIG. 1, the level of superheat 104 at the outlet of the heat exchanger 16 can be measured via a suitable superheat sensor 28. This superheat sensor 28 might be arranged to determine refrigerant temperature and pressure at the outlet of the heat exchanger 16, or alternatively may be at the suction inlet of the compressor 12, as shown. The superheat 104 is adjusted via use of the expansion valve 18, which is controlled via the control system 26 of the heat pump system. This control can be done in any suitable fashion. In this example the control system 26 also receives a measure of outside air temperature from an outside air temperature sensor 30, as shown. This provides a simple way to determine temperatures with a risk of frosting when the heat pump system should switch to the second mode of operation, as well as utilising sensors 28, 30 that are often already present in the heat pump system for other reasons.

What is claimed is:

1. A method for operating a heat pump system, the heat pump system comprising: a compression device, a heat rejecting heat exchanger, an expansion device and a heat absorbing heat exchanger; wherein the expansion device provides a controllable degree of expansion; the method comprising:

determining a temperature indicative of frosting conditions on an exterior surface of the heat absorbing heat exchanger;

operating the heat pump system in a first mode if the temperature indicative of frosting conditions is above a threshold value; and operating the heat pump system in a second mode if the temperature indicative of frosting conditions is within a range of temperatures that is below the threshold value;

wherein in the second mode the heat pump system is arranged to adjust the degree of expansion at the expansion device to increase the superheat at the outlet of the heat absorbing heat exchanger compared to the superheat when operating in the first mode to thereby increase an external temperature of the heat absorbing heat exchanger;

wherein the range of temperatures below the threshold value is a range having a lower bound where the heat pump system is switched back to the first mode of operation.

2. A method as claimed in claim 1, wherein the step of determining a temperature indicative of frosting conditions comprises determining the outside air temperature.

3. A method as claimed in claim 1, wherein the step of determining a temperature indicative of frosting conditions comprises determining a temperature linked to the outside air temperature and/or to the temperature of the exterior surface of the heat absorbing heat exchanger.

4. A method as claimed in claim 1, wherein when the temperature indicative of frosting conditions is within the range of temperatures below the threshold value the expansion device is controlled in order that the level of superheat is sufficient to prevent frost formation on the heat absorbing heat exchanger without any additional heating.

5. A method as claimed in claim 1, wherein the degree of expansion at the expansion device is actively controlled, with the degree of expansion varying as the temperature indicative of frosting conditions varies.

6. A method as claimed in claim 1, wherein the first mode of operation comprises control of superheat for minimum superheat in the heat absorbing heat exchanger; and wherein the second mode of operation comprises increasing superheat sufficient to prevent frost without significantly exceeding that increase.

7. A method as claimed in claim 1, wherein the threshold value is a first threshold value, and the range of temperatures below the first threshold value is a range between the first threshold value, and a second threshold value that is lower than the first threshold value; and wherein the heat pump system is switched from the first mode of operation to the second mode of operation at the first threshold value, in order to delay frost formation, and switched from the second mode of operation to the first mode of operation at the second threshold value.

8. A method as claimed in claim 7, wherein the first threshold value is a temperature indicative of an outside air temperature in the range 6-13° C.

9. A method as claimed in claim 7, wherein the second threshold value is a temperature indicative of an outside air temperature in the range 0-6° C.

10. A method as claimed in claim 1, comprising using the second mode of operation when the temperature indicative of frosting conditions is indicative of an outside air temperature in the range 2-10° C.

11. A method as claimed in claim 1, comprising determining superheat of the refrigerant at the outlet of the heat absorbing heat exchanger via measurements of refrigerant temperature and pressure at the outlet of the heat absorbing heat exchanger and/or at the compressor suction inlet.

12. A method as claimed in claim 1, wherein the heat absorbing heat exchanger is an evaporator of the heat pump system and the evaporator has multiple rows of heat absorbing elements.

13. A computer programme product comprising instructions for execution on a controller for a heat pump system comprising: a compression device, a heat rejecting heat exchanger, an expansion device and a heat absorbing heat exchanger; wherein the expansion device provides a controllable degree of expansion; wherein the instructions, when executed will configure the controller to operate the heat pump system in accordance with a method as claimed in claim 1.

14. A heat pump system comprising: a compression device, a heat rejecting heat exchanger, an expansion device and a heat absorbing heat exchanger; wherein the expansion device provides a controllable degree of expansion;

the heat pump system being arranged to:

receive measurements for a temperature indicative of frosting conditions on an exterior surface of the heat absorbing heat exchanger, operate in a first mode if the temperature indicative of frosting conditions is above a threshold value, and operate in a second mode if the temperature indicative of frosting conditions is within a range of temperatures that is below the threshold value, wherein in the second mode the heat pump system is arranged to adjust the degree of expansion at the expansion device to increase the superheat at the outlet of the heat absorbing heat exchanger compared to the superheat when operating in the first mode to thereby increase an external temperature of the heat absorbing heat exchanger;

wherein the range of temperatures below the threshold value is a range having a lower bound where the heat pump system is switched back to the first mode of operation.

15. A method for operating a heat pump system, the heat pump system comprising: a compression device, a heat rejecting heat exchanger, an expansion device and a heat absorbing heat exchanger; wherein the expansion device provides a controllable degree of expansion; the method comprising:

determining a temperature indicative of frosting conditions on an exterior surface of the heat absorbing heat exchanger;

operating the heat pump system in a first mode if the temperature indicative of frosting conditions is above a threshold value; and operating the heat pump system in a second mode if the temperature indicative of frosting conditions is within a range of temperatures that is below the threshold value;

wherein in the second mode the heat pump system is arranged to adjust the degree of expansion at the expansion device to increase the superheat at the outlet of the heat absorbing heat exchanger compared to the superheat when operating in the first mode to thereby increase an external temperature of the heat absorbing heat exchanger;

wherein the threshold value is a first threshold value, and the range of temperatures below the first threshold value is a range between the first threshold value, and a second threshold value that is lower than the first threshold value; and wherein the heat pump system is switched from the first mode of operation to the second mode of operation at the first threshold value, in order to delay frost formation, and switched from the second mode of operation to the first mode of operation at the second threshold value.

16. A heat pump system comprising: a compression device, a heat rejecting heat exchanger, an expansion device and a heat absorbing heat exchanger; wherein the expansion device provides a controllable degree of expansion;

the heat pump system being arranged to:

receive measurements for a temperature indicative of frosting conditions on an exterior surface of the heat absorbing heat exchanger, operate in a first mode if the temperature indicative of frosting conditions is above a threshold value, and operate in a second mode if the temperature indicative of frosting conditions is within a range of temperatures that is below the threshold value, wherein in the second mode the heat pump system is arranged to adjust the degree of expansion at the expansion device to increase the superheat at the outlet of the heat absorbing heat exchanger compared to the superheat when operating in the first mode to thereby increase an external temperature of the heat absorbing heat exchanger;

wherein the threshold value is a first threshold value, and the range of temperatures below the first threshold value is a range between the first threshold value, and a second threshold value that is lower than the first threshold value; and wherein the heat pump system is switched from the first mode of operation to the second mode of operation at the first threshold value, in order to delay frost formation, and switched from the second mode of operation to the first mode of operation at the second threshold value.

* * * * *